United States Patent [19]

King et al.

[11] Patent Number: 4,863,018

[45] Date of Patent: Sep. 5, 1989

[54] PACKING SYSTEM FOR LUGGAGE CASE

[75] Inventors: William L. King, Denver; Daniel G. Elles, Kittredge; David A. Koontz, Parker, all of Colo.

[73] Assignee: Samsonite Corporation, Denver, Colo.

[21] Appl. No.: 318,451

[22] Filed: Mar. 1, 1989

Related U.S. Application Data

[63] Continuation of Ser. No. 164,042, Mar. 4, 1988, abandoned.

[51] Int. Cl.[4] ..... A45C 5/12; A45C 13/30; B65D 85/18

[52] U.S. Cl. ..... 206/290; 206/298; 190/13 C; 190/36

[58] Field of Search ..... 190/100, 13 C, 36; 206/278, 279, 284, 286–292, 298; 211/113; 248/339

[56] References Cited

U.S. PATENT DOCUMENTS

| | | | |
|---|---|---|---|
| 1,651,706 | 12/1927 | Holbrook | 206/287 |
| 2,362,807 | 11/1944 | Dresner | 206/289 |
| 2,626,689 | 1/1953 | Davis et al. | 206/287.1 |
| 3,831,740 | 8/1974 | Pendergast et al. | 206/287 X |
| 4,091,976 | 5/1978 | Morse | 206/279 X |
| 4,189,036 | 2/1980 | Pelavin | 206/287.1 X |
| 4,363,388 | 12/1982 | London et al. | 24/517 |
| 4,585,120 | 4/1986 | Jaffe | 206/287.1 X |
| 4,662,513 | 5/1987 | King et al. | 206/287.1 |

FOREIGN PATENT DOCUMENTS

| | | | |
|---|---|---|---|
| 2184008 | 6/1987 | United Kingdom | 190/100 |

OTHER PUBLICATIONS

Product Sheet, Samsonite Corp., "Samonite is Putting the Suit Back in the Suitcase", Copyright 1987.

Catalog U, Shwader Brothers Inc., p. 11, "A New and Simple Hanger", 1935–1936.

Product Catalog, ITW Nexus, Dated 1987, p. 9, "Fix-lock" TM Cam Buckle.

*Primary Examiner*—Sue A. Weaver

*Attorney, Agent, or Firm*—Gregory W. O'Connor

[57] ABSTRACT

Luggage case have included devices for holding garments on hangers. These devices usually consisted of a clamp-like device for holding the hook portion of special hangers together with a ladder-like rack which was laid over the garments in the case. Then the garments were folded over this ladder-like device. Such systems tended to the cumbersome and did not easily permit the use of ordinary closet hangers. The disclosed system includes a buckle and strap arrangement that holds the hook portions of a number of closet type hangers, regardless of style or construction, snugly and compactly near a wall of the luggage case. A simple packing bar comprises a laterally extending rod held by flexible rod supports. The rod supports are detachably pivotably mounted to opposite side walls of the case and have a length which permits adjustable positioning of the rod relative to the bottom wall of the case depending on the number and thickness of the clothing being packed.

4 Claims, 2 Drawing Sheets

PACKING SYSTEM FOR LUGGAGE CASE

This is a continuation of co-pending application Ser. No. 07/164,042 filed on Mar. 4, 1988, now abandoned.

FIELD OF THE INVENTION

This invention relates to luggage for traveling which includes a system for neatly holding garments, specifically garments on hangers. More particularly, the invention relates to the very simple and inexpensive set of accessories for a luggage case wherein garments on ordinary closet hangers can be quickly and neatly packed for travel.

BACKGROUND OF THE INVENTION

Luggage for travel can be categorized into two general types of luggage, soft luggage and hard-shelled luggage. However, both of these general types may include packing systems specifically for holding clothing on hangers. One type of travel goods has been sold for many decades under the trademark "Silhouette" by Samsonite Corporation of Denver, Colo. Most of this time certain pieces in this line of luggage have included a C-shaped plastic clip with a wire bail across the open jaws of the C-shaped aperture for retaining hangers having specially shaped hook portions. Ordinary closet hangers could also be retained, but with less security. This C-shaped structure was held by rivets to the center of one wal of a shell of the case, specifically the wall near the hinge which attaches the upper and lower shells of the case. Garments hanging on these specially shaped hangers were placed in the case, the bail wire closed over the open jaws of the plastic clip. A ladder-like accessory, having a series of laterally extending bars was then placed over the hanger-supported garments and the garments were folded over this ladder-like implement. With the case closed, the garments were prevented from slumping toward the bottom of the case by these lateral bars and the hangers helped to prevent the shoulder portions of the garments from shifting to and fro during transport of the case. While this system has served well for a number of years, it included many inherent limitations. The C-shaped hanger support did not securely hold ordinary closet hangers, thus during vigorous transport the hangers could become loose. The ladder-like packing implement was bulky and did not adjust well to carrying amounts of clothes on hangers.

Several packing systems have been proposed specifically designed for a softside travel goods, specifically as a garment bag. One such system is detailed in U.S. Pat. No. 4,618,058 issued to Samsonite Corporation. However, while the hanger trolley disclosed in that patent is quite effective in retaining the hooked portions of varying styles of closet hangers, it is generally too complicated and bulky to work effectively in smaller cases where the length of the packing space available from the top of the closet hangers to the lower opposite edge of the suitcase is at a premium. Thus, it would be desirable to provide a system for holding clothing on hangers that was extremely compact such that the tops of hangers were moved close to the side of the luggage case having the hanger-supporting device. It would also be desirable to provide a system that is not as bulky as the folding implement of the prior art, yet provided a neat way to support the garments in whatever orientation the particular luggage case is transported.

BRIEF SUMMARY OF THE INVENTION

This invention provides a simple system for holding hooked portions of ordinary closet hangers of any style and is easily adjustable for one or several of such hangers, and holds those hangers very close to the side of the luggage case to which the device is attached. In conjunction, the invention provides an adjustable packing bar system which is held close to the other end of the luggage case and thus holds one or several garments smoothly. The packing bar is provided with supports which are pivotable and releasably attached to proposed sides of the luggage case. When operated together, the hanger support and the packing bar provide a remarkably simple yet effective and versatile system for packing garments on hangers in a luggage case. In a preferred embodiment, the hanger support comprises a buckle which is attached to the center of one wall of the luggage case and a strap, one end being fixedly attached to the body of the buckle, the other passing through the buckle and being releasably held by a pivotable catch of the buckle to thus form an adjustable loop. The packing rod in the preferred embodiment comprises a generally rounded cylindrical rod firmly attached to rod supports. The rod supports have a predetermined length which permits adjustment of the distance between the rod and the adjacent wall of the suitcase by pivoting around snap-like attachments which releasably attach the ends of the rod supports to opposite side walls of the suitcase.

Other features and aspects of the invention, as well as the invention's various benefits, will become clear in the detailed description of the preferred embodiment which follows.

DETAILED DESCRIPTION OF THE PREFERRED EMBODIMENT

Figure 1:
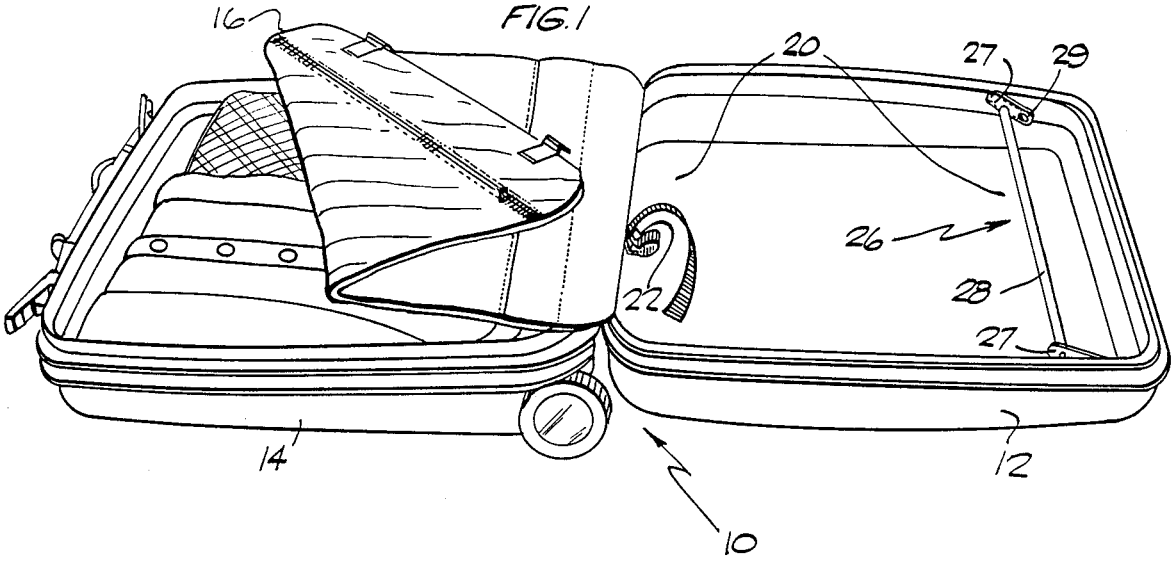
FIG. 1 is a pictorial view of the luggage case in the open condition showing the packing system of the instant invention.
Figure 2:
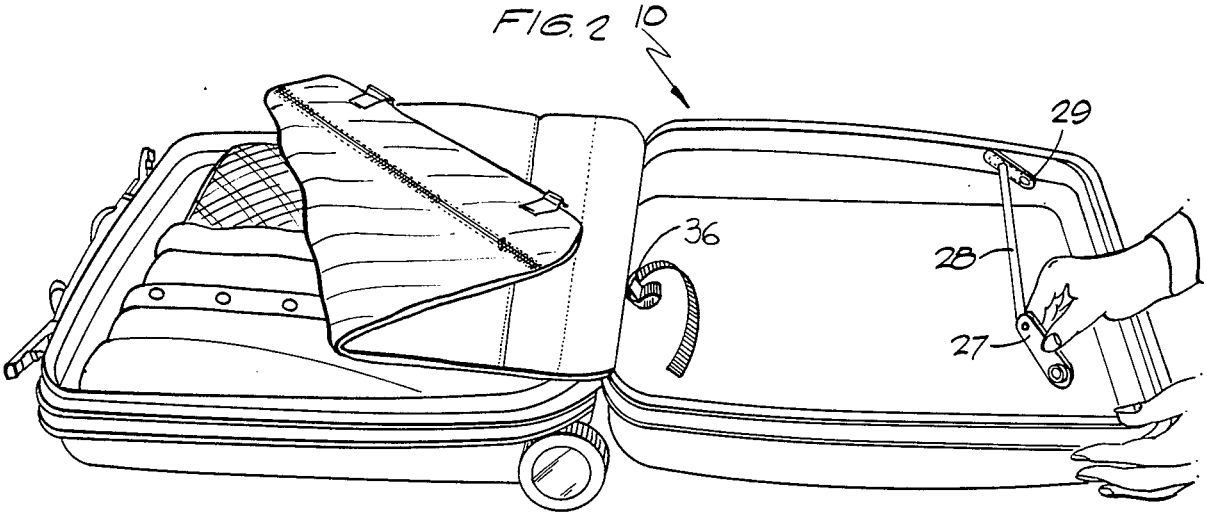
FIG. 2 shows a similar view to FIG. 1 with the packing system being operated.

Referring to the figures, the suitcase 10 of the hard-side type is shown, including a lid portion 12 and a bottom shell 14. A divider pad 16 is shown attached at one edge at or near the hinged interengagement of the lid shell 12 and bottom shell 14. The divider pad has a number of functions, but in this case its primary function is to hold hanging garments and other things in the lid shell 12 and to isolate those cloths fromo those cloths already packed in bottom shell 14 shown below the divider pad.

The packing system 20 is shown contained in the lid shell 12. It comprises a packing bar 26 which is made up of a pair of rod supports 27, permanently attached to either end of rod 28. At the other end of each of the rod supports 27 is a releasable connecting device 29, which can be selectively attached to corresponding attaching means attached at about the mid-line of the opposite walls of the lid shell 12. In the preferred embodiment, the releasable attaching means 29 are heavy duty snaps of known type. As will be detailed, the snaps permit the packing bar 26 to be removed completely from the case and also permit the packing bar to be pivotally attached so that the rod supports swivel around the snaps 29 during use.

The packing system also includes the hanger support 22. The hanger support can be seen best in FIG. 3. Fixedly attached to the center of a first wall of shell 12 is a buckle 32 which comprises a body portion 34 and a pivotal catch 35. The body portion 34 is permanently attached to that lower wall by rivets (not shown) or the like. The buckle 32 is a generally known type, and may be metal or plastic. The preferred buckle is that designated as part number Fix Lock #320 available from ITW Nexus of Chicago, Ill. Attached to and passing through the buckle 32 is a buckle strap 36 preferably made of cross-grain webbing made of nylon or polyester fiber. A length of the strap, which includes the free end 37 of the strp passes through the body portion 34 of the buckle and is releasably gripped by the pivotal catch 35. At its opposite end the buckle strp 36 is permanently attached to the bottom wall of the case and is preferably fastened between the bottom wall of the case and the body portion of 34 of the buckle by the same rivets (not shown) that attach the buckle to that wall. In this way, the strap 36 forms a loop 39 through which one or more plurality of the hooked portions H of closet hangers may be placed.

Figure 3:
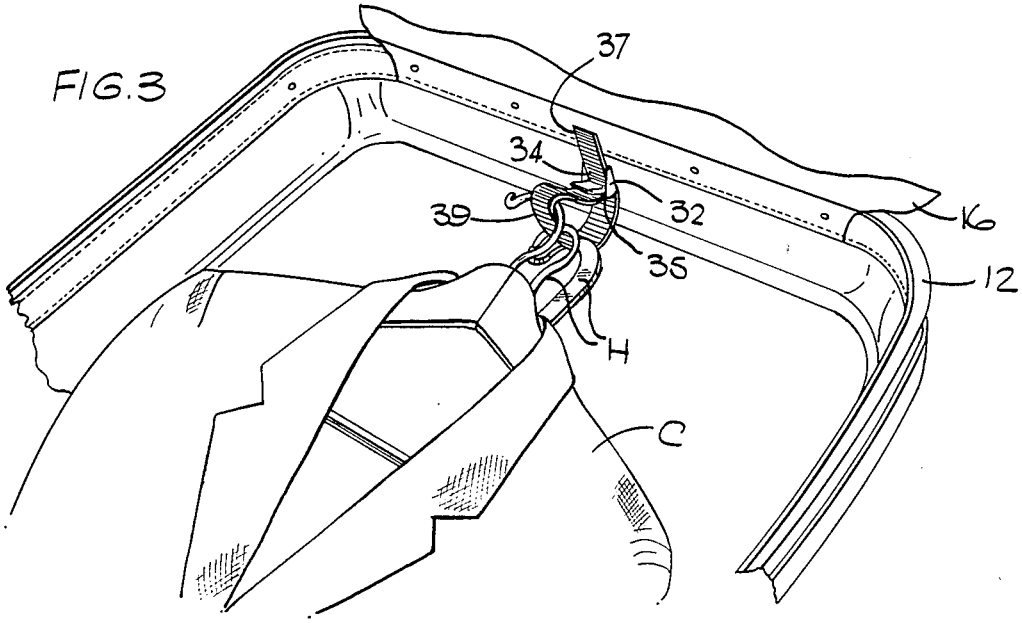
FIG. 3 is a detailed view of part of the packing system.
Figure 4:
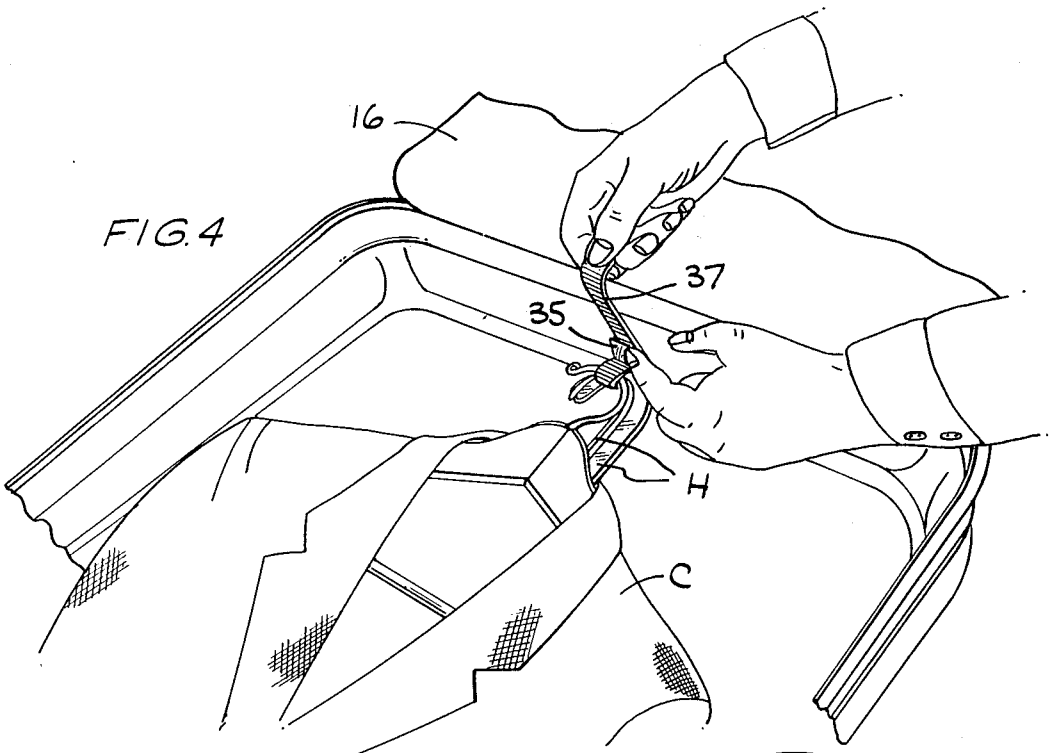
FIG. 4 details a further operation of the packing system in a view similar to FIG. 3.
Figure 5:
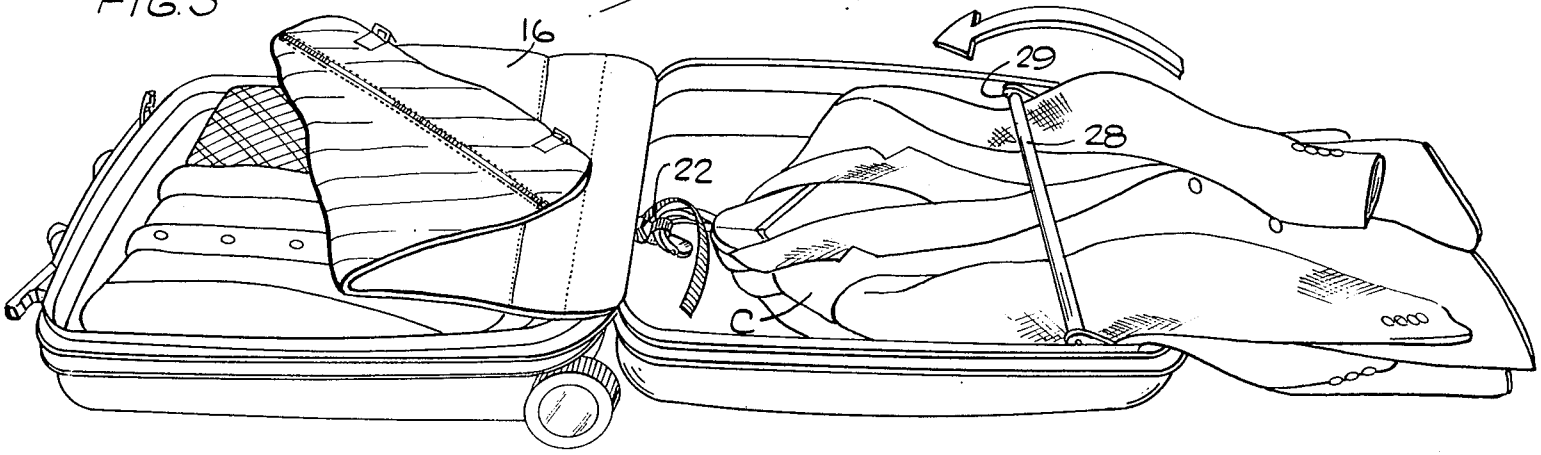
FIG. 5 shows the last steps in the operation of the instant invention.

As illustrated in FIG. 3, the hooked portions of the hangers can be of many different types: thin wire hangers, heavy plastic hangers which present problems for other systems in holding such varying hanger types. As can be seen in FIGS. 3 through 5, these hangers support clothing. While a man's sport coat is illustrative, it should be understood that any clothing normally hanging in a closet can be packed using the system disclosed. The operation and benefits of the subject invention will now be illustrated.

Referring again to FIG. 3, it can been seen that the buckle strap 36 is positioned to form a fairly large loop 39 through which the hooked portions of the hangers edge can be easily threaded. Prior to placing the hooks through the loop however, the travel would first remove the packing bar 26 by releasing the snaps 29 and placing the packing bar to the side. Alternatively, the traveler could release only one of the snaps 29 since the rod supports 27 are preferably of a flexible leather-like strap construction which would permit flexing of the rod away from the clothing while the clothing is laid into the shell 12.

Once those cloths to be packed are selected and the hooked portions of the hanger supporting them are placed through the loop, the exposed length of strap of the strap is pulled. This has two effects. The first pulse all of the hangers towards the bottom wall of the shell 12. This has the effect of smoothing the clothing as well as aligning all the hangers for a neat appearance within the case. It also obviously permits the firm gripping of the hooked portions, so as to prevent them from becoming loose during travel. Once the loop 39 has been tightened, the pivotal catch 35 is rotated to lock the strp in this tightened condition (FIG.4). In particular, the pivotal catch has a cam portion which clamps down on thestrap, trapping it between the body portion 32 and catch 35.

Once this is done the packing bar 26 is placed over the clothing as shown in FIG. 5. One or both of the snaps are attached to hold the packing bar 26 in place over the clothing. Depending on the number of and thickness of hanging garments that have been placed in the manner shown in FIG. 5, the packing bar will pivot either closer or farther away from the lower wall of the shell 12. It has been found that the rod supports 27 should have a distance between the snaps 29 and the rod of about $1\frac{1}{2}$ to about $2\frac{1}{2}$ inches, depending on the depth of the shell 12. In this way, the rod supports 27 permit easy and natural positioning of the rod 28 relative to the bottom of the shell.

In any event, once the packing bar is in place, the side of the case is folded about the packing rod 27. Finally, the opposite shell 14 of the case is closed over the hanger supported clothing, the latches are latched and the traveler is prepared to depart.

Thus it can be seen the present invention provides a simple, cost-effective, yet remarkably efficient way to pack hanging cloths. The buckle and buckle strap arrangement places the hooked portions of the hangers as close as reasonably possible to the side wall of the case shell. In this way, the dimension of the case in the direction of the length of the garments can be optimally used, in contrast with other systems. Secondly, every type of closet hanger may be used. The traveler need not remove the clothing from ordinary closet hangers and place them on specific travel hangers which often are in short supply in the traveler's closet. The packing bar is relatively small and compact, thanks to the ability of the rod supports 27 to adjustably support the rod 26 without the need for several attachment points in order to provide an adjustment for the number of hanging clothes to be packed. Also, the traveler has the option of either leaving the packing bar attached with the snaps 29 in the shell 12, or merely unsnapping the packing bar and placing it in the bottom of the shell should the traveler not wish to pack hanger-supported garments. Or the packing rod may be removed completely.

Although a preferred embodiment of the invention has been described, it should be obvious that changes to specific details of this embodiment can be made without departing from the spirit and scope of the invention as defined in the following claims. For example, while a strap and buckle arrangement is shown, a cord and a cleat to snub the line when it is pulled to grip the hanger hooks could be used and obtain the advantages demonstrated by the preferred embodiment.

We claim:

1. In a luggage piece having a first wall and another wall opposing said first wall and spaced therefrom, a packing system comprising:

a hanger support for attachment to said first wall, the hanger support comprising a buckle, a body portion of the buckle permanently attached to said first wall, a catch attached thereto, a buckle strap having a first end which is permanently attached adjacent the buckle to said first wall, a length of said buckle strap passing through the buckle and being releasably held thereby, the buckle strap forming a loop, said length of said buckle strap comprising a means for adjusting said loop, whereby the hooked portions of hangers supporting clothing thereon may be passed through the loop and the loop may be adjusted around to frimly grip the hooked portion of the hangers, whereby the hangers are held within the luggage.

2. A packing system set forth in claim 1 further comprising a packing bar positioned towards said another wall of said luggage piece, said packing bar including a rod and rod supports releasably attached to said luggage piece, and means for releasably attaching said rod supports to said luggage piece which provide for pivotal movement of said rod supports.

3. The packing system as set forth in claim 2 wherein said rod supports have a first end for attaching to said rod and a second end, said means for releasably attaching being positioned on said second end.

4. A packing system as set forth in claim 3 wherein said rod supports have a predetermined length such that said rod is held by said rod supports parallel to said another wall of said luggage piece, and said rod supports are permitted to pivot around said means for releasably attaching, in response to the total thickness of garments being supported by said hanger and engaged by said rod.

* * * * *